US006899619B2

(12) United States Patent
Efremov

(10) Patent No.: US 6,899,619 B2
(45) Date of Patent: May 31, 2005

(54) METHOD FOR GAME OF STOS

(76) Inventor: Ivan Pavlovich Efremov, ul. Zoologicheskaya d. 22. kv. 115, Moscow 123242 (RU)

( * ) Notice: Subject to any disclaimer, the term of this patent is extended or adjusted under 35 U.S.C. 154(b) by 172 days.

(21) Appl. No.: 10/116,189

(22) Filed: Apr. 4, 2002

(65) Prior Publication Data

US 2003/0013509 A1 Jan. 16, 2003

(30) Foreign Application Priority Data

Jul. 9, 2001 (RU) ..... 2001118728
Oct. 19, 2001 (RU) ..... PCT/RU01/00430

(51) Int. Cl.[7] ..... A63F 13/00

(52) U.S. Cl. ..... 463/11; 463/12; 463/13; 273/292; 273/274

(58) Field of Search ..... 463/11, 12, 13; 273/292, 274; D21/369

(56) References Cited

U.S. PATENT DOCUMENTS

| | | | | | |
|---|---|---|---|---|---|
| 1,970,731 | A | * | 8/1934 | Boggess | 273/143 C |
| D161,352 | S | * | 12/1950 | Madieu | D21/354 |
| 4,362,303 | A | * | 12/1982 | Pell | 273/274 |
| 4,836,553 | A | | 6/1989 | Suttle et al. | |
| 5,216,234 | A | * | 6/1993 | Bell | 235/494 |
| 5,431,407 | A | * | 7/1995 | Hofberg et al. | 273/292 |
| 5,713,573 | A | * | 2/1998 | Nazaryan | 273/292 |
| 5,918,884 | A | * | 7/1999 | DiMuro | 273/292 |
| 5,941,769 | A | | 8/1999 | Order | |
| D421,466 | S | | 3/2000 | McBride | |
| RE36,739 | E | * | 6/2000 | Gutierrez | 273/292 |
| D442,643 | S | | 5/2001 | Florence | |
| 6,325,375 | B1 | * | 12/2001 | Potter et al. | 273/292 |
| 6,343,789 | B1 | * | 2/2002 | Webb | 273/274 |
| 6,409,602 | B1 | * | 6/2002 | Wiltshire et al. | 463/42 |
| 6,428,002 | B1 | * | 8/2002 | Baranauskas | 273/236 |

FOREIGN PATENT DOCUMENTS

| | | | | |
|---|---|---|---|---|
| EP | 1310279 | A1 | * 5/2003 | A63F/1/00 |
| RU | 2060756 | C1 | 5/1996 | |
| RU | 2099782 | C1 | 12/1997 | |
| RU | 2137521 | C1 | 9/1999 | |
| RU | 2151622 | C1 | 6/2000 | |
| RU | 14135 | U1 | 7/2000 | |
| RU | 2162359 | C1 | 1/2001 | |

OTHER PUBLICATIONS

Scarne, John, "Encyclipedia of Games" Harper & Row, New York 1973 pp 302–307.*

Vogel, Ed, "Former dealer hopes for redurn of Faro", Las Vegas Review, Oct. 23, 2000.*

The game of Faro—History and Rules for the King of Old West Card Games accessed from [www.bcvc.net/faro/] undated.*

Scarne, J., Scarne's Encyclopedia of Card Games, 1973, pp. 304–309, Harper & Row.

Lesnoi, Dmitrly, Encyclopedia Igomiy Dom, [Playing House Encyclopedia]. 1994, p. 607–608, Polina Publishing House, Moscow, Russia.

* cited by examiner

*Primary Examiner*—Jessica J. Harrison
(74) *Attorney, Agent, or Firm*—Fitch, Even, Tabin & Flannery

(57) ABSTRACT

The method of entertainment "Stos" is an adaptation for casinos, videogame machines and computers of the most popular game of chance in the eighteenth and nineteenth centuries. It is also known as Bank Table, Shtoss and Pharaon. In a casino, the game takes place on a table on which there is a game field with suit-less cards and four suit cards: spades (♠), clubs (♣), diamonds (♦) and hearts (♥). The game generally uses one or several standard 52-card decks. The players bet that the card they select will be dealt out of the deck on an even interval. To do so, they place their chips on a suit-less card that they pick on the game field. They may also predict the suit of their card by placing a bet on one of the suit cards. After the cards are shuffled and cut, the dealer places the cards face down on the table and draws the cards in order, two at a time. All bets on a card are considered played as soon as the first matching card is dealt from the deck. The player loses if the card upon which he bet turns up in the odd column and he wins if it falls in the even one.

18 Claims, 5 Drawing Sheets

METHOD FOR GAME OF STOS

FIELD OF THE INVENTION

The present group of inventions relates to a method of entertainment and equipment needed for the game in gaming halls; the method can also be used in the video and e-versions of <<Stos>>.

BACKGROUND OF THE INVENTION

The present invention relates to a method of entertainment and equipment needed for the game in gaming halls; the method can also be used in the video and e-versions of Stos.

The method of entertainment "Stos" is a modern adaptation of a game "Shtoss", which was the most popular game of chance of the eighteenth and nineteenth centuries, for casinos, game machines and computers. The rules of this game were quite simple: the player lost if the card he selected was dealt from the deck on an odd interval, and he won if it was dealt at an even interval. There were many variations of this game: in Europe "Pharaoh", in Russia "Bank Table" or "Shtoss", in America "Faro" or "Stuss". The reference to game "Shtoss" can be found in the Russian-language encyclopedia "Igorniy Dom Encyclopedia" (p. 607, Dmitri Lesnoi, Polina, 1994) The majority of the patented games below are based on well-known games related to "Shtoss" and "Pharaoh". However, those names are poorly adapted for casino play, and for that reason are not used in modern casinos.

An established method of entertainment that requires the use of a game table with a playing field marked with spaces for bets, a deck of cards and a selection of chips of different values for placing bets (RU #2,151,622, published Jun. 27, 2000 IPC A 63 F 1/00, 1/18, 9/24, 11/00). Another established method of entertainment that also requires a game table with a defined playing field, a deck of cards and a selection of chips of different value (RU #2,137,521, published Sep. 20, 1999, IPC A 63 F 1/00).

A method of entertainment that uses a game table with a hollow in its central section for the placement of a chip rack with chips of value (RU #2,139,748, published Oct. 20, 1999, IPC A 63 F 1/06, 1/18, 9/24). This patent also discloses the markings on the cover of the game table, with the definition of the boxes for bet placement.

Poker games are the prototype of the method of entertainment "Stos", with the use of a semicircular game table with the flat edge having a hole for the placement of a chip rack with valued chips. Poker uses a standard deck of 52 cards, chips of varying values and a cover on the game table with outlines marking the playing field (U.S. Pat. No. 4,836,553, published Jun. 6, 1989, IPC A 63 F 1/00, US Cl. 273/292; 273/274). The disadvantages of these commonly known methods are related to the complexity of the equipment being used and its high price.

An established computer strategy game that comprises of a computer with a monitor and with a means to load information from the user of the computer system and a means of displaying on the screen an array of elements (RU #2,099,782, published Dec. 20, 1997, IPC G 06 F 19/00, G 06 F 161:00). The method of presentation to the player on the computer screen, characterized in that the display reflects the game field, is also written up in this reference.

An established method of conducting electronic games for money bets with the use of an electronic device with a monitor (RU #2,162,359, published Jan. 27, 2001, IPC A 63 F 9/24, A 63 F 13/10, G 06F 17/00).

An established videogame machine that relates to entertainment and card games played on electronic video machines (RU #2,060,756, published May 27, 1996, IPC A 63 F 9/22, G 07 F 17/32). A disadvantage of this heretofore-known computer game and of the abovementioned videogame machines resides in their inadequate fascinating quality and the difficulty of using these games on a local or global network.

The technical results of the proposed inventions enhance the functional capabilities and absorbing capacity of the game. By simply refitting a typical gaming table to play "Stos", casinos can increase the spectrum of choices available to their clients. This method of entertainment, created with the aid of an electronic device provided with a monitor, introduces the possibility of a user playing "Stos" with other players not in his close proximity.

SUMMARY OF THE INVENTION

The aforesaid results are achieved in that, according to the first invention, there is proposed a method of entertainment making use of a game table, a chip rack, chips, a deck of cards and a cover with the outline of the table's layout. One or more players place bets and the dealer, using a deck of randomly shuffled cards, deals out winning or losing bets. The table's layout, according to the invention, comprises cards without the suit specified and for four suit cards: spades (♠), clubs (♣), diamonds (♦) and hearts (♥).

At the beginning of the game, the player bets that the card he picks will be dealt from the deck on an even interval. To place the bet, he places a valued chip on one of the suit-less cards on the table's cover. The dealer shuffles the cards and then deals the cards from the deck in order, dealing them in pairs. According to the invention, the results of the match are decided according to the following: if none of the cards that the player selected are turned up in the two dealt cards, then the dealer deals the next two cards from the deck. If a selected card is dealt on an odd interval from the deck, then the player who bet on that value loses his bet, and the dealer removes the chips from the table. If a selected card is dealt on an even interval from the deck, then the player's bet on that value is doubled and the player can remove his bet from the table.

According to the invention, all bets on a card are considered played as soon as the first matching card is dealt from the deck. After calculating the results of the pair of cards, the dealer continues to deal cards from the deck in pairs, until the next card upon which there is a bet is drawn. The dealer deals from the deck and calculates the wins and losses until all the cards upon which bets were made have been turned up.

It is possible to vary the outline of the table's layout by changing the amount of cards used. For example, when the table layout consists of thirteen locations for suit-less cards (Ace (A), two, three, four, five, six, seven, eight, nine, ten, Jack (J), Queen (Q), King (K)), a standard 52-card deck of four suits with thirteen cards each is used. When the table layout maintains eight locations for suit-less cards (seven, eight, nine, ten, Jack, Queen, King, Ace), a 32-card deck of four suits with eight cards each is used. The house can chose a table layout with between seven and fourteen locations for suit-less cards, taken from the following list: Ace, two, three, four, five, six, seven, eight, nine, ten, Jack, Queen, King, Joker. In this case, it is more convenient to use a deck with four suits and a selection of cards in each suit ranging from seven to thirteen, according to the number of locations on the relevant table layout, taken from the following list: Ace, two, three, four, five, six, seven, eight, nine, ten, Jack, Queen, King, and one or two suit-less Jokers.

The table layout can also contain a space for the shuffled deck of cards. Next to that location, there can be two spaces with the following legends: on one side, "Odd" and on the other, "Even". Or, on one side, "Loss" and on the other, "Win", or "Odd Loses" and "Even Wins". When several players are participating, different colored chips can be used to identify each individual's bets.

The colored chips can be located in the chip rack next to the valued chips. In that case, to differentiate each chip's value, oval tokens are used with a value printed on the center and on the long border of the token. The oval tokens stand behind the colored chips so that the face value on the side is visible.

The colored chips can be secured by attaching a protective corner. This device has mesh pockets that can hold tokens that represent the value of the row of colored chips behind them.

It is possible to use several decks of cards in "Stos". In this case, the dealer shuffles all the decks and places them in a card shoe, as is done in blackjack or baccarat.

The player chooses an available chip color, fixes the chips' value and places a bet on his chosen card values. He can predict their suit by placing a bet on one of the suit cards.

The results of the drawing are realized in the following fashion:

After shuffling and cutting, the dealer places the deck of cards face down in front of him and deals the cards from the deck in order, one pair at a time. The odd draws are placed in the "Odd" box and the evens in the "Even" box. If a card value selected by the player falls on an odd interval and the suit of that card is the same as the suit selected by the player, the dealer takes all the chips bet on the suit card. If the losing card's suit matches the player's selection only in color, the dealer wins one-half of the player's bet on the suit. If the losing card has a suit that does not match in color, the player's bet on the suit remains untouched.

In the event that the player still has bets on other cards and loses half of his bet on a suit card, the dealer moves the player's chips to the line of the suit card, so that half of the chip or pile of chips remains inside line of the card. If the situation repeats itself, the bet is reduced by half again, and the chip or pile of chips is moved to the corner of the suit card, so that one-quarter of the original bet remains in the card.

The dealer pays out the winnings for bets in the suit by increasing the bet on them, depending on the corresponding suit of the dealt winning card. If the suit matches, the player's bet is doubled. If the suit matches only in color, the player's bet is increased by half. If the suit does not match, the bet remains untouched.

If the bet on the suit needs to be doubled and the chips were moved earlier to the corner or line, the dealer moves the chips from the corner to the line or from the line to the interior of the suit card. If a pair of cards with the same value is turned up in the same round, then only the bets placed on the suit-less card are lost, and all bets on the suits remain untouched.

To increase the game's dynamics, bets can be placed on suit-less cards and the suit cards after any pair of cards has been dealt from the deck and before the next round is drawn. The dealer returns the chips remaining on the suit cards after the final card is drawn that still has a bet placed on it. After that, the player can finish the game. After drawing all the cards that had been bet on, and after the final accounting, the dealer stops dealing cards from the deck and begins collecting bets for the next game.

According to the second embodiment of the method of entertainment, a complete set that has been adapted for card games in gaming facilities is proposed in order to enable the application of the method of the first invention as well as for the application of other methods of entertainment.

The set for the method of entertainment includes:

a card table, a table cover with the outline of the game field, a chip rack, valued chips, a deck of cards and a card for cutting the deck, a booklet with the rules of the game, characterized in that, according to the invention:

a cover with the outline of the game field contains locations for the suit-less cards, and one card each for spades (♠), clubs (♣), diamonds (♦) and hearts (♥);

a set of colored chips;

a protective corner for the chips attached to the corner of the table, as well as oval tokens with their short end having the same diameter as the colored chips and their long edge having a slightly larger diameter. The oval tokens have face values written on their centers and along their long edges.

The cover can contain thirteen spaces for suit-less cards: Ace, two, three, four, five, six, seven, eight, nine, ten, Jack, Queen, King. In this case, a standard deck of cards contains 52 cards: four suits with thirteen cards in each suit.

Another variation consists of a table cover with eight spaces for suit-less cards: seven, eight, nine, ten, Jack, Queen, King, Ace. In this case, a deck contains32 cards: four suits with thirteen cards in each suit.

The third variation for the table cover can contain spaces for between seven and fourteen suit-less cards, chosen from the following selection: Ace, two, three, four, five, six, seven, eight, nine, ten, Jack, Queen, King, Joker. In this case, the deck can contain between 28 and 54 cards, with four suits with between seven and thirteen cards each and one or two suit-less Jokers.

The set can contain several decks of cards, which would come with a card shoe that can hold several decks of cards.

In addition, the cover can include a space for shuffling the cards.

The table cover can also include boxes for "Odd" and "Even" cards. These boxes can also read "Loss" and "Win" or "Odd Loses" and "Even Wins".

On the table cover, all the spaces for suit-less cards, the suit cards and other boxes and writing can be encircled with a borderline, defining the game field. In this case, the playing field on the cover can be dyed a different color from the rest of the cover.

The set can come with a container to store the colored chips, and the container can have a lock.

The set also comes with a corner for the played cards.

Finally, for the comfort of the players, the set will come with a tablet that has the minimum and maximum bets allowed at the table posted and a booklet containing all the rules of "Stos".

In the complete set for playing Stos, a booklet with the rules of the game is included, with the details dependant on the amount of cards and decks the casinos has ordered for the game. For example, if a casino orders six decks of cards and a shoe for them, the booklet would contain the following text:

Stos

Game Rules

Stos is a modern casino adaptation of the most popular, exciting game of chance of the eighteenth and nineteenth centuries. In Europe, the game was called Pharaon, in America—Faro, and in Russia—Shtoss. The layout of the game table consists of spaces for 13 suit-less cards and four suit cards: spades (♠), clubs, (♣), diamonds (♦) and hearts (♥). There are also two boxes for the placement of cards that are drawn on an even or odd interval from the card shoe.

Stos uses six decks of cards. The dealer shuffles them and places them into the shoe. The players place their bets with either valued chips or colored chips with an assigned value. Bets may not be higher than the maximum or lower than the minimum allowed at the table. The player bets that his designated card will be dealt from the shoe on an even interval. The player can bet on several cards by placing his chips on the suit-less cards marked on the game field. After the players place their chips on their chosen cards, the dealer says that the bets are placed and the game begins. The dealer deals cards from the shoe and turns up them in pairs. The cards drawn on an odd interval are placed on one side, while the cards dealt on an even interval are placed on the other. All bets on a card are considered played as soon as the first matching card is dealt from the deck, regardless of its suit.

The player loses if the card that he bet on is dealt from the deck at an odd interval. This card is called a "Loser" and the dealer takes the player's chips that were placed on the card. The player wins if the card is dealt on an even interval, and this is called a "Winner". The dealer pays out one-to-one for all the bets on the card.

If after the payoff the player does not take the chips and the winnings from the "Winner", those chips are considered bets on the same card in the next hand. Any bet may be placed after the payoffs from the last hand and before the dealing of the next pair of cards (the "send-off"). After taking any new bets, the dealer turns up the next pair of cards from the shoe.

The player can designate the suit of the cards he is betting on by placing a bet on one of the suit cards. A bet on a suit card represents all the chips of the same color on the game field.

If a player's card falls in the odd pile (a "Loser"), the player loses and the sum of his loss for bets placed on a suit card is calculated by the following system:

If the suit of the "Loser" is the same suit as the player designated (a "full-color"), the dealer takes all of the player's chips;

If the suit of the "Loser" coincides only in color (a "half-color"), the dealer takes one-half the bet;

If both the suit and the color of the "Loser" are different (a "simple"), then the bet on the suit card remains unchanged.

When the suit of the losing card only matches in color (a "half-color"), and the player still has bets on cards in the game, the dealer halves the player's bet. The dealer moves the chips onto the line of the suit card, so that one-half of the chip or of the pile of chips is located inside the card. If the situation repeats itself, the bet is halved again and the chip or pile of chips that are moved to the corner of the suit card, so that one-quarter of the original bet remains in the card.

If a player's card is dealt from the deck on an even interval (a "Winner"), the player wins and the dealer increases the player's bet on the suit depending on the standing of the dealt card:

If the suit coincides with the card (a "full-color"), the wager is doubled;

If the suit's color is the same (a "half-color") one-half the bet is added;

If the suit and the color differ (a "simple"), the bet remains the same.

If the bet needs to be doubled (a "full-color") and his bets are placed on the corner or on the line of the suit card, the dealer moves the chips from the corner to the line or from the line to the suit card.

In a situation where any pair of drawn cards is of the same value (a "Plie"), the odd card is considered dealt first, and any bets on it is lost. However, all bets on the suit cards remain unaffected. If the player still has bets in the game remaining on cards, the bet remains on the suit card. During play, the player can only take his winnings or chips that exceed the table's maximum from the suit card.

If the player places a new bet on a card and the suit card still has his chips on it, then the suit of the newly placed bet remains the same. Changing the bet on a suit card is not allowed. While the player still has bets on cards, he may refresh a lost bet on the suit card, or he may play the rest of the bets on the cards without accounting for the suit of the cards. The dealer returns any chips that remain on the suit cards after the final suit-less card upon which the player placed a bet has been dealt. After that, the player may finish the game.

After the deck has been cut, new bets are not accepted, and any cards with the bets already on them must be played until the end. After all the cards upon which bets have been placed are dealt, and after the payoffs have been calculated, the dealer stops drawing cards from the shoe.

According to the third embodiment of the method of entertainment, "Stos" can be realized with the aid of an electronic device provided with a monitor, characterized in that:

a driver adapts the data and fulfills the user commands with the aid of a computer program saved on a computer-read data carrier;

the feed of information into an electronic device is realized through at least one input means;

random number generators are used;

an electronic deck of cards is used;

before the game, an electronic game field is formed where, according to the invention, the electronic deck consists of four suits of up to thirteen of the following cards: Ace, two, three, four, five, six, seven, eight, nine, ten, Jack, Queen, King, as well as one or two suit-less Jokers;

the playing field presented on the display is formed from the suit-less cards taken from the composition of the electronic deck in combination with four suit cards (spades (♠), clubs (♣), diamonds (♦) and hearts (♥));

on the monitor, functional buttons for the registering the corresponding commands in the electronic device are displayed.

At the beginning of the game, the player places a bet that the card he picks will be drawn from the electronic deck on an even interval by placing his chips on the selected suit-less card located on the table's layout. After shuffling the electronic deck, the cards are drawn from the deck in order, dealt in pairs. The next pair is dealt if one of the cards that the player has picked does not coincide with the two dealt cards from the electronic deck. The player's bet is lost if one of the cards on which he bet is dealt on an odd interval from the electronic deck. The player's bet is doubled if one of the cards on which he bet is dealt on an even interval from the electronic deck. The player's bet on a card is considered played as soon as the first matching card is dealt from the electronic deck. After accounting for the dealt pair of cards, the game continues to deal in pairs from the electronic deck until upon another card upon which the player has placed a bet appears. After the next accounting with the player, another pair is dealt from the electronic deck and it is determined if the player won or lost anything until all the cards upon which the player has bet have been dealt.

During this, for clarity and the ease of the player, the table's layout can be divided by borderlines, and the game field can be a different color than the color of the rest of the screen.

If he wishes, the player can use several electronic decks of cards and, in this case, an image of a shoe to hold the several decks of cards can be placed on the playing field. The functional buttons for sending commands that are displayed on the monitor to the electronic device can be as follows:

"Play"—begins a new game or pauses the game and reactivates it;

"Repeat"—repeats the size of the previous game's bets;

"Double"—doubles the standing bet;

"Cancel"—cancels the last bet;

"Cash Out"—ends the game, paying out the balance due to the player.

For the sake of player's comfort, his standing will be displayed on the monitor, showing his balance. Likewise, the sum of his winnings or losses from the beginning of the game and the result of the last hand will be displayed.

For the sake of clarity and for the ease of the player, a space for shuffling the cards and also for the "Odd" and "Even" areas may be formulated on the playing field.

On the table, these boxes can also read "Loss" and "Win" or "Odd Loses" and "Even Wins". The cards in the electronic decks can have pictures on their backs and dealing begins with the top card.

At the beginning of the game, the player can place bets on several cards that he believes will be dealt at an even interval from the electronic deck. To do so, he leaves his chips on the chosen cards that have been formulated on the game field.

Now that the player has placed bets on the suit-less cards, he can pick their suit by placing a bet on a suit card. The chosen suit will represent all the suit-less cards bet on. For the ease of the player, during play the dealt cards from the electronic deck that land on odd will be moved to a space marked "Odd" or "Odd Loses", while the cards that land on even will be moved to a space with the words "Even" or "Even Wins". The drawing is realized in the following fashion:

If a player's card falls from the electronic deck on an odd interval, i.e., on the losing space, and the suit of that card is the same as the suit card that the player bet on, then the player loses the entire bet. If the suit is only the same color as the player's suit card, then he loses half of his bet. If the card is the other color, then the bet on the suit card remains unchanged.

When the suit of the losing card matches only in color and the player still has bets on other suit-less cards remaining on the table, the bet on the suit card is halved and moved to the line of the card, so that one half the chip or pile of chips remains in the card. If the situation repeats itself, the chip or pile of chips is moved to the corner of the suit card, so that one-quarter is left inside the card.

If the player has a winning card come up even and he has bet on a suit card, the bet is increased according to the corresponding suit of the dealt card. If the suit is the same, his bet is doubled. If the colors match, his bet is increased by half. If the suit is a different color from the suit card he bet on, the bet remains unchanged.

If the player's bet is doubled on the suit card and his chip is on the line or in the corner of the card, then the chip is moved from the corner to the line or from the line into center of the card.

In the event that a pair of two cards with the same number is dealt, the player only loses his bet on the suit-less card, and the bet placed on the suit card remains unaffected.

The player has the option to place bets on the suit-less cards and on the suit cards after any pair has been dealt from the electronic deck and before the next pair is dealt. After the player's last bet on a suit-less card has been removed, the chips that were left on the suit card are combined with the player's chips, which are represented on the monitor outside the game field. The player can stop the game after the final card upon which the player has made a bet is dealt from the electronic deck. Finally, after all the cards upon which bets were made have turned up and all the bets have been accounted for, the program stops dealing cards from the deck and begins taking bets for the next game.

The game can be accompanied with sound and video effects.

Other features and many of the attendant advantages of these inventions will be hereinafter described in detail with references to the accompanying drawings illustrating the preferred embodiments thereof.

DETAILED DESCRIPTION OF THE PREFERRED EMBODIMENTS

Figure 1:
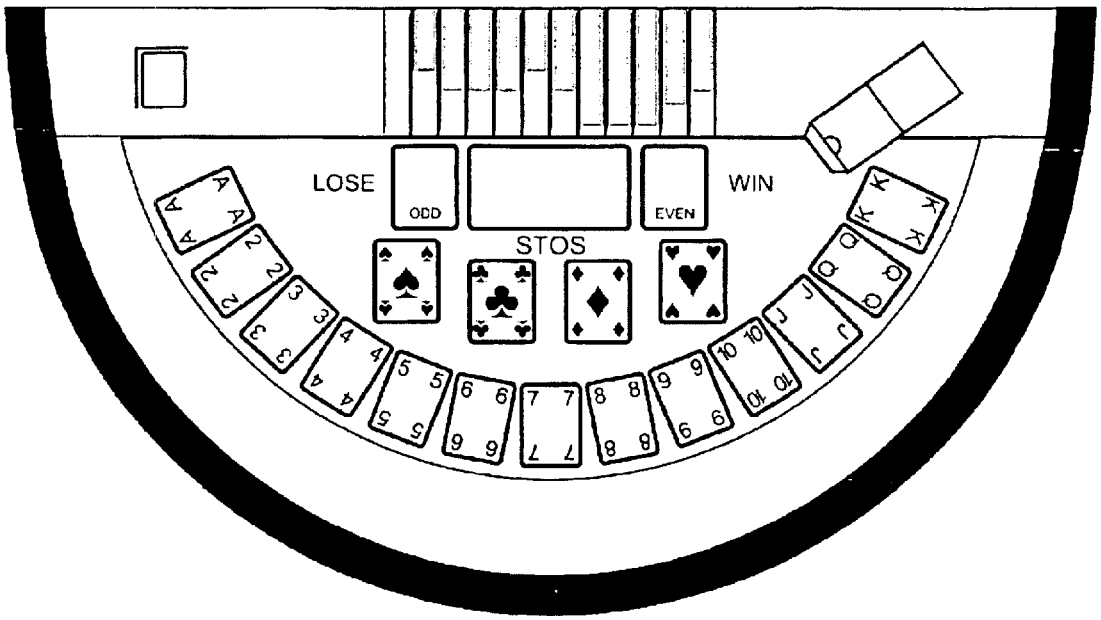
FIG. 1 shows the game table for the proposed method of entertainment "Stos", using a rack for colored chips.
Figure 2:
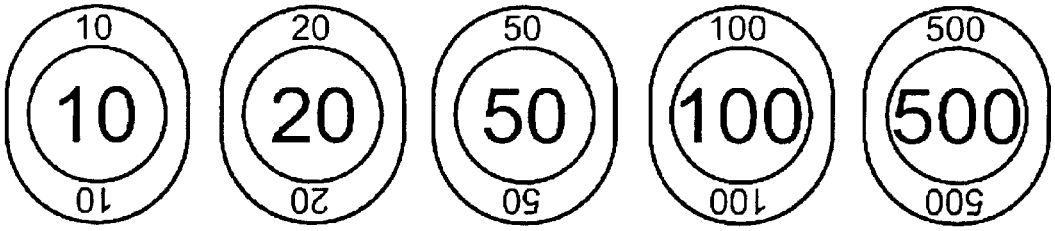
FIG. 2 shows oval tokens that indicate the value of the various colored chips in the rack.
Figure 3:
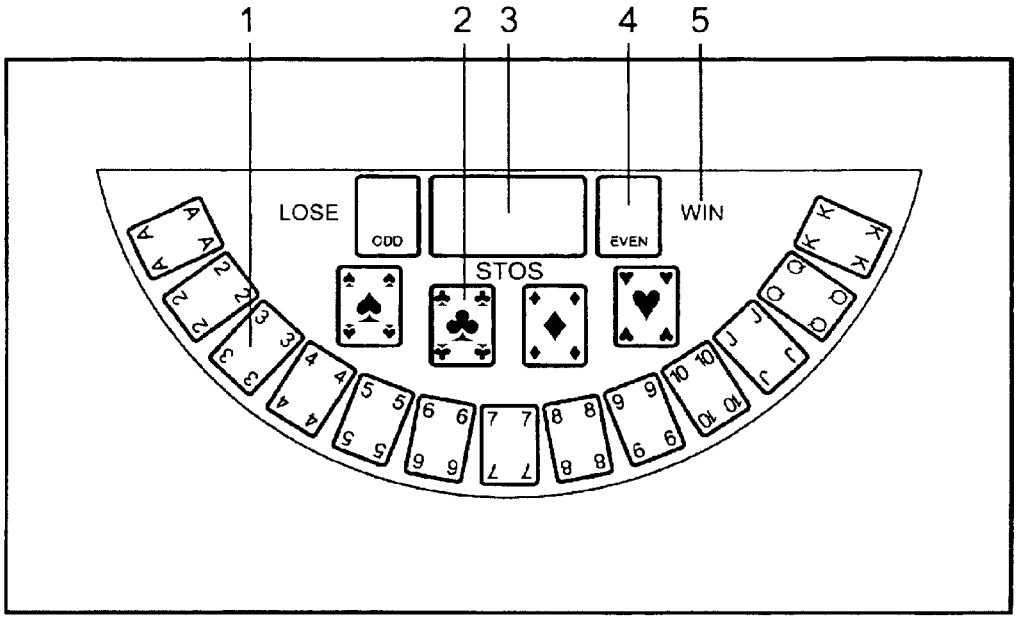
FIG. 3 shows a table cover for "Stos" with the outlines of the game field.
Figure 4:
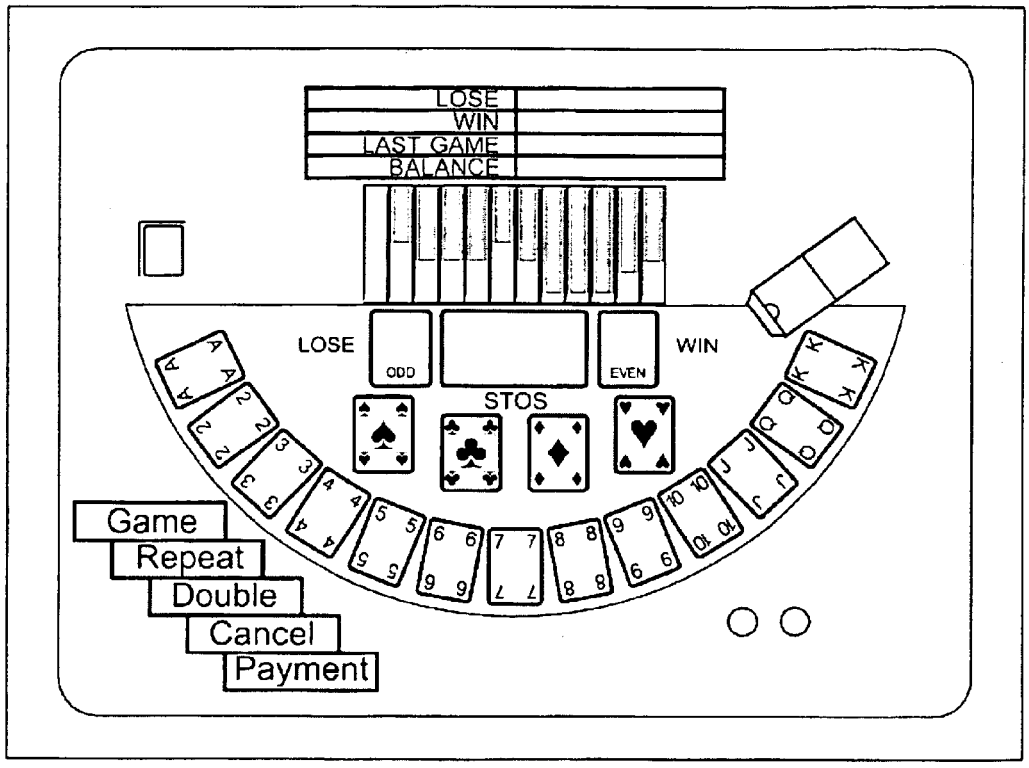
FIG. 4 shows a projection on the monitor of an electronic device representing the realization of the method of entertainment "Stos"
Figure 5:
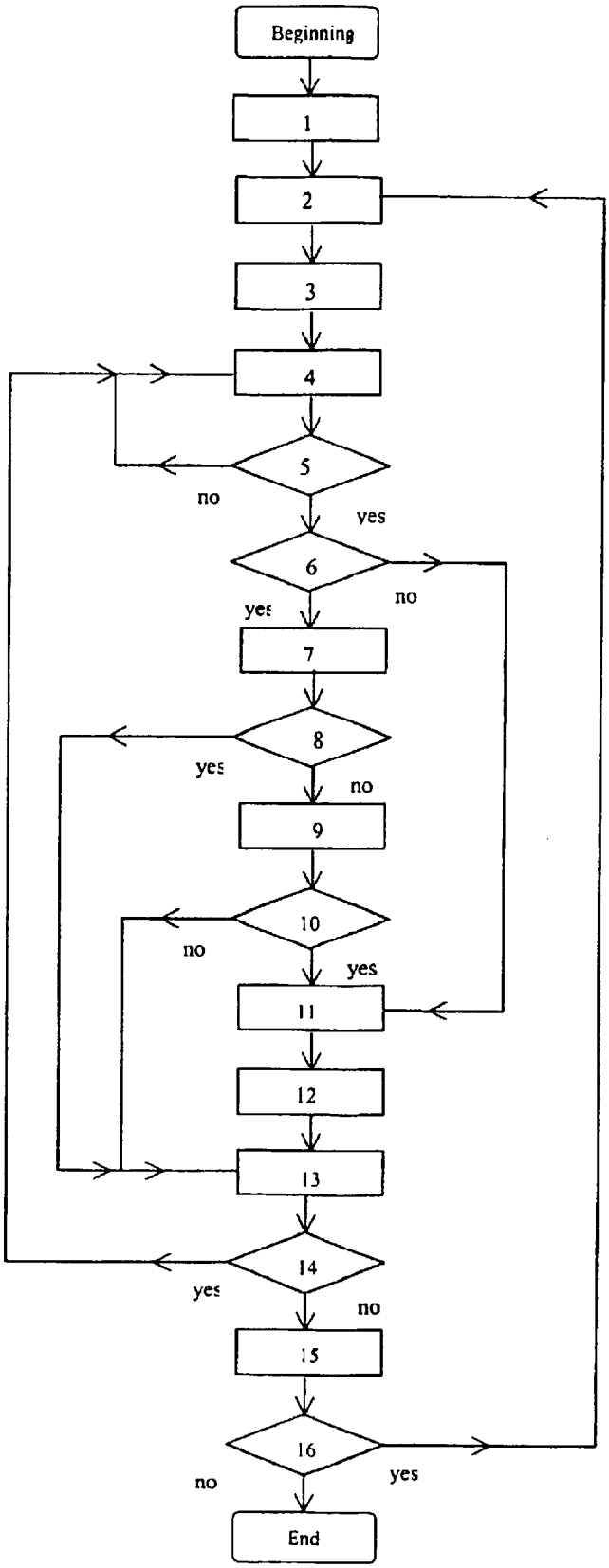
FIG. 5 shows a block-diagram of the basic algorithm of entertainment "Stos".

Referring now to the accompanying drawings, FIG. 5 presents an original table cover that has been prepared for a semicircular card table with the outlines of one of the variations of the game field for the realization of bets. On the cover, there is an arch of suit-less cards (1): Ace (A), two, three, four, five, six, seven, eight, nine, ten, Jack (J), Queen (Q), King (K). Slightly higher are four suit cards: spades (♠), clubs (♣), diamonds (♦) and hearts (♥). Still higher are three marked spaces: in the center there is a box for shuffling (3), on the left is an "Odd" box (4) with "Loses" written next thereto and on the right is an "Even" box with "Wins" written next thereto. All of the suit-less cards, the suit cards and the boxes are outlined with lines, forming a sector called the game field (5).

The marked table cover is stretched on a specially prepared cover, reinforced with metal staples and placed on a semicircular table. The cover can be made of cloth, wool or cotton fabric. It can also be made from synthetic materials, including synthetic fabric, or real or fake leather, etc., produced by light industrial enterprises. The color scheme of the markings on the cover of the game table can be realized using various production methods.

The realization of the markings on the table cover allows for the easy refitting of a typical game table for the method of entertainment "Stos" and also allows casinos to increase the number of games available to their clients.

Of the many ways to use the method of entertainment "Stos" in a casino, the most preferable is when the game is played on a semicircular table usually reserved for Blackjack. On the game field, there is an arch of the thirteen spaces for the suit-less cards (1): Ace (A), two, three, four, five, six, seven, eight, nine, ten, Jack (J), Queen (Q), King (K). Slightly higher are four suit cards: spades (♠), clubs (♣), diamonds (♦) and hearts (♥). Between the suit cards and the chip rack are three marked spaces: in the center there is a box for shuffling (3), on the left is an "Odd" box (4) with "Loses" written next thereto and on the right is an "Even" space with "Wins" written next thereto. All of the suit-less cards, the suit cards and the other boxes are outlined with lines, forming a sector called the game field. The players cannot bring chips that are not used in the betting to the table. The chip rack is a closable tray with wavelike depressions for the chips, located in the center of the straight edge of the table.

Just like when playing roulette, players can use either colored chips or chips with values. Chips with values appear as plastic disks of various colors with a nominal value that can be accepted as a bet and can be exchanged for money at the cashier's booth. When several players are playing at one table, it is more comfortable to use colored chips, with each player using his own color. The players are offered different colored plastic disks that work for betting in the game and can be exchanged for chips with value. The colored chips may only be used at a single game table and they cannot be exchanged for money. The colored chips stand at the table in rolls of 20 chips. A protective corner with mesh pockets that is made of plastic or another prepared material is attached to the table to shield these chips. In the pockets, oval tokens with face values or valued chips can be placed to represent the value of the colored chips standing in front of them.

The colored chips can also be placed in a standard covered chip rack together with valued chips. In this case, oval tokens that are the same thickness as the chips demonstrate the value of the colored chips. The ovals' long edge are approximately one centimeter longer than the chips' diameter and bear a number printed on their long edge. These oval tokens stand in the sunken rack behind colored chips. The price of the colored chips is defined by the face value of the token standing behind them, and the token is positioned in such a way that its face value is visible.

The game usually uses a standard poker deck, consisting of 52 cards: four suits with 13 cards each. A deck of32 cards can also be used: four suits with eight cards each. Other selections are also possible.

The player chooses an available color of chips and appoints their value, which must be within the limits of the minimum and maximum bets of the table.

The players place bets on whichever cards he thinks will be dealt on an even interval. While the dealer shuffles the deck of cards, the players place bets on the selected cards by placing colored chips on the suit-less cards on the playing field. The players can assign a suit to the chosen cards by placing a bet on one of the suit cards. Any bet placed on a suit is assigned to all the suit-less cards that the player has bet on. Bets cannot be less than the minimum or more than the maximum set at the table.

After the players have placed their bets, the dealer clarifies that all bets are down. Either one of the players or the dealer cuts the deck of plastic cards. Removing or changing bets after the cut is prohibited. The dealer places the deck in front of him and deals the two top cards. The first is placed on his right side into the "Odd" space and the second is placed on his left side into the "Even" space.

According to the invention, all bets on a card are considered played as soon as the first matching card is dealt from the deck. The player loses if a card upon which he bet falls into the odd pile, and that card is called a "Loser". The dealer takes the lost chips that had been bet on that card. The player wins if a card upon which he bet falls into the even pile and that card is called a "Winner". The dealer pays all the winning bets one to one on the winning card. After the payment, the players must take their chips from the played card so that only cards that have not been played remain in the game. The suit-less cards with already played bets are taken out of the game after the first time that card is dealt. After accounting for the first pair, the dealer deals the second pair of cards (the "send-off"). The dealer takes cards from the deck in turn, dealing them in pairs. The discarded odd cards are placed on one side, the evens on the other. When a card upon which a bet has been made turns up, the dealer takes the lost bets from the card if the card landed on the "Odd" pile or pays out the bet if the card landed on the "Even" pile. The dealer deals pairs of cards in this way every time and, if there are not any cards with bets on a given turn, the dealer continues dealing the next round. This continues until the dealer overturns a card with a bet.

In case two cards of the same face value are turned up together in one turn, the card is considered to have landed on odd first, and so the player loses his bet and the dealer takes the chips that had been placed on that card. If a bet has been placed on both cards that were dealt in a turn, the dealer can pay the winnings from the even card out of the chips that were lost on the odd card.

When betting on the face values, the player can also identify the suit of these cards by placing his colored chips on suit card that he wants. If one of his cards is dealt from the deck odd—a "Loser"—and the suit of the cards is the same as the suit card that the player picked (a "color"), then the dealer takes the entire bet. If the suit card is the same color as the dealt card (a "half-color"), the dealer takes half the bet. If the "Loser" is the other color (a "simple"), the bet on the suit card remains unchanged. If there are still any suit-less cards with bets on them in the game, a reduced or a saved bet remains on the suit card. When the suit of a losing card corresponds only in color (a "half-color") and there are still suit-less cards with bets on them, the dealer takes half of the value away by moving the chips to the line of the suit card so that only half of the chip remains inside the card. If this situation repeats itself, the bet is reduced by another half and the dealer moves the chip or pile of chips into the corner of the suit card, so that only one-quarter of the bet is remaining in the card.

In case any pair of two cards of the same value is dealt (a "Plie"), the dealer only takes away the chips that were bet on that suit-less card, and the chips that are standing on the suit card remain untouched.

The dealer pays out the winnings for bets on the suit card by increasing the bet on them, depending on the corresponding suit of the dealt card. If the suit matches (a "color"), the player's bet is doubled. If the suit matches only in color (a "half-color"), the player's bet is increased by half. If the suit does not match (a "simple"), the bet remains untouched. If there are still bets remaining on any suit-less cards, the dealer adds to the bet on the suit card or leaves it untouched, without removing it from the field of play. If the bet on the card needs to be doubled and the chips were moved earlier to the line or to the corner, the dealer moves the chips from the line to the center or from the corner to the line of the card.

Bets that are entirely lost while betting on the suit card are removed from the game, and the rest of the game is played with only bets on the remaining suit cards. The dealer pays out for the chips located on the suit cards after the player's final card is dealt from the deck. The player can stop playing after the payout for his final card. When all the suit-less cards upon which bets were placed have been played and the dealer has paid them off, the dealer stops dealing cards from the deck and collects all the dealt cards together. He invites players to make new bets and shuffles the cards.

When "Stos" is played with several cards, the dealer shuffles the decks together and places them in the shoe, just like in blackjack or baccarat. A card shoe is an adaptation in which that several decks of cards have been shuffled together in order to preserve the succession of the cards and it makes drawing the cards from the deck more convenient. The dealer takes the cards from the shoe in order, turns them face up and places them on the table in pairs. The cards that are selected on an odd interval are placed on one side, the cards selected on an even interval on the other.

The mathematical advantage that a casino has on bets on the suit-less cards is four percent. The odds on bets on the suit cards are even for the player and house. Since betting only on the suit cards is impossible, "Stos" is a winning game for the casino.

The computer game "Stos" is realized with the aid of a computer system to process the data and the information fed by the user into a computer system with a monitor. Any computer system or system with a monitor is adequate for the computer game "Stos". The algorithm of the game is based on the conditions of the method of entertainment "Stos", and the particulars of this programming provision are written in a programming language. The program is saved on hard drives, CD ROM or other means for storing information.

The preferred embodiment of the game appears as a computer program, saved onto a CD ROM and played on a personal computer. An example of the optimum computer for "Stos" is an IBM PC that can plug into a motherboard with a Pentium processor, RAM of at least 1 MB, hard drive with at least a few GB, a sound card and a color monitor.

The monitor shows an image of the electronic game field, with functional buttons and chips for making bets. The game can automatically take out the electronic deck of cards and shuffle the deck several times.

The rules of the game and directions followed are the analog of the casino version.

By either typing on a standard keyboard the equivalent of the face value of a card or by picking the cards with the mouse on the monitor, the player can pick the suit-less cards, select their suit, place a bet on a suit card and appoint the size of his bets. After the cards have been shuffled, they are set down. During play, cards from the deck are dealt in pairs, starting with the top card. The cards that are drawn on an odd interval are placed on the left, over the inscription "Odds Lose", and the cards that are drawn on an even interval are placed on the right, over an inscription "Evens Win". All bets on a suit-less card are considered played as soon as the first matching card is dealt from the deck. The player loses if the card upon which he placed a bet lands on odd and he wins if that card lands on even. The player can use the commands "Play", "Repeat", "Double", "Cancel", and "Cash Out". On the display there is a status window with the current balance of the game, as well as the total sum won or lost from the beginning of the session and the results of the last and current bets. The game utilizes sounds and video effects.

In FIG. 6 there is an image of the display of the electronic version with the reflection of the "Stos" game field and the status window has "Instant Marking" written thereon. In "Stos", a Marking is the cycle of the game, starting from shuffling the cards and ending with the final payments after the player's last card has turned up. "Stos" in an Internet casino or on a local network is used in the same way as on a computer, with the only exception that on the Internet or on a network several players can play at once and, more importantly, can play for money. For this, a manager's program for a casino server and a client's program for extraction of information from the player's computer are used. Using the client's program, the game field is formed on the computer's display and, together with the player's input, forms an electronic deck and establishes the player's balance on the status window, depending on the size of the player's account in the Internet casino.

The transfer of money for bets in the Internet casino or in the game room on a local network is realized with the aid of a credit card or bank transfer. The player's winnings are transferred to his bank account.

If "Stos" is played using a mobile electronic system, then the program can be written with the aid of, for example, installed SBIS microsystems or with a PC-card payment method. When using a mobile system with a program written in SBIS microsystems or on a memory stick, a player can play in any place, including transport. It is possible for the organizers to pay a winning player by fixing the balance of his winnings onto the display of his electronic game and saving it in the microchip's memory.

An even more effective realization of "Stos" is using a videogame machine. There are fourteen buttons on the control panel of the video machine with the letters or symbols representing the suit-less cards and four buttons that represent the suit cards. At the top of the panel are another five buttons: "Play", "Repeat", "Double", "Cancel", and "Cash Out". Pressing on one activates the function assigned thereto. Under the display are the instructions on how to play the game, a table describing winnings, the maximum and the minimum bets, and the name of the game.

On the monitor is an image of the game field, on which there are fourteen suit-less face values and four suits. The player can pick the deck of cards to be used by him and play with several decks if he wants to. Generally, the game uses a deck of 54 cards. The deck is located above the images of the cards and the cards are flipped over at the start of the game. During the time of play, the cards from the deck are flipped in pairs: the cards drawn on an odd interval are placed on the left on top of "Odds Loses" and the cards drawn on an even interval are placed on the right on "Even Wins".

The player chooses the suit-less cards that he wants to bet on and presses the buttons representing those cards. He can also select a suit for the selected cards by placing a wager by pressing one buttons representing a suit card. He can also, using the buttons, repeat, cancel or double his bet. The rules of the game and order of action is consistent with the rules of "Stos" listed above. After shuffling the electronic deck, the cards are placed with the pictures face down. The cards are revealed in pairs, starting with the top card. All bets on a suit-less card are considered played as soon as the first matching card is dealt from the deck. The player loses if a card he selected falls in the odd pile, and he wins if the card comes up even.

On the monitor there is a status window that displays the game's balance, the sum won or lost from the beginning of the game and the results of the pervious and current bets. The game utilizes video and sound effects. When the player hits the "Cash Out" button, tokens are dropped in a pot placed under the control panel. For any payments over 400 tokens, the player is given a check.

FIG. 7 is a block-diagram of the basic algorithm used in the electronic version in order to realize the method of entertainment "Stos". The steps of the processing of presentation in this block-diagram are as follows:

1. First stop for the status window: formulate the beginning balance of the game
2. Compose the electronic deck of cards (in accordance with the player's wishes) and shuffle the cards using a random number generator
3. Take bets on suit-less cards and, if desired, on suit cards
4. Deal the first two cards from the electronic deck. The first of them is an odd and the second is even
5. One of the cards matches one of the suit-less cards selected by the player
6. One of the values that the player bet on falls into the odd column from the electronic deck
7. The player's bet that was placed on the card that landed in the odd pile from the electronic deck loses
8. Both dealt cards from the electronic deck have the same face value (a "Plie")
9. Bet processing on the suits:
   If the bet on the suit matches with the suit of the odd card from the electronic deck (a "color"), the bet is lost
   If the bet on the suit matches with the color of the suit of the odd card (a "half-color"), then half of the bet is lost
   If the bet on the suit is on the remaining two suits, the bet remains unchanged
10. One of the cards that the player bet on lands in the even pile from the electronic deck
11. The player's bet on the value that turned up in the even pile from the electronic deck is doubled. The doubled bet is returned to the player and no longer is part of the game
12. Bet processing on the suits:
   If the bet on the suit matches with the suit of the even card from the electronic deck (a "color"), the bet is doubled
   If the bet on the suit matches with the color of the suit of the even card (a "half-color"), then the bet wins one and a half times its value
   If the bet on the suit is on the remaining two suits, the bet remains unchanged
13. Modification of the status window
14. Un-played bets on suit-less cards remain on the table
15. Remaining bets on the suit cards on the table are returned to the player
16. The player continues the game
17. End of game While there have been illustrated and described particular embodiments of the present invention, it will be appreciated that numerous changes and modifications will occur to those skilled in the art, and it is intended in the appended claims to cover all those changes and modifications which fall within the true spirit and scope of the present invention.

What is claimed is:

1. A method of entertainment using a game table, a chip rack, a table cover with an outline of a game field, chips and at least one deck of cards and a card shoe, wherein at least one player places bets by means of chips and a dealer, using a random arrangement of shuffled cards, uncovers winning or losing bets, the method comprising the steps of:

(a) providing a table layout maintaining spaces for suit-less cards and for four suit cards: spades (♠), clubs (♣), diamonds (♦) and hearts (♥);

(b) beginning a game by the player placing a bet on whether or not a selected card will be dealt from the deck on an even interval by placing a valued chip on a suit-less card on the table cover;

(c) along with placing bets on suit-less cards, the player chooses a suit by placing a bet on one of the suit cards;

(d) shuffling the decks by the dealer, placing them on the card shoe and then dealing the cards in order, uncovering them in pairs, odd on one side and even on another;

(e) removing by the dealer losing chips from the table if the selected suit-less card is dealt on an odd interval from the deck, because the player who bet on said card lost his bet;

(f) doubling by the dealer winning chips on the table if the selected suit-less card is dealt on an even interval from the deck, because the player won his bet on said card;

(g) considering all bets on a card played as soon as a first matching card is dealt from the deck; and (h) placing additional bets by the player after any pair of cards has been dealt from the shoe and before the following pair is dealt, wherein the dealer is continuing to deal cards from the deck in pairs after calculating for each pair of cards, and determining wins and losses until all suit-less cards upon which bets were made have been turned up.

2. The method of claim 1, wherein the game field comprises spaces for thirteen suit-less cards (Ace, two, three, four, five, six, seven, eight, nine, ten, Jack, Queen, King).

3. The method of claim 1, wherein the deck is a standard deck of 52 cards: four suits with 13 cards in each.

4. The method of claim 1, wherein the game field comprises spaces for between seven and fourteen suit-less cards taken from the following: Ace, two, three, four, five, six, seven, eight, nine, ten, Jack, Queen, King, Joker.

5. The method of claim 1, wherein the deck comprises between 28 and 54 cards: four suits having between seven and thirteen cards each, taken from the following: Ace, two, three, four, five, six, seven, eight, nine, ten, Jack, Queen, King, as well as two suit-less Jokers.

6. The method of claim 1, wherein the game field contains a space for the shuffled deck of cards.

7. The method of claim 1, wherein the game field contains one space with an inscription "Odd Lose" and one with "Even Win".

8. The method of claim 1, wherein the dealer deals the cards from the shoe, with odd draws placed in the space inscribed "Odd Lose" and even draws placed in the space inscribed "Even Win".

9. The method of claim 1, wherein colored chips with an appointed value are used to place bets on chosen cards.

10. The method of claim 1, wherein when a card upon which the player has bet lands on an odd pile it becomes a losing card, and when the suit of said losing card matches the suit card the player placed the bet on, the dealer takes all chips bet; if the suit of the losing card matches only in color, the dealer takes half of the chips bet on the suit; if the losing card is of another suit, then the player's bet on the suit card remains untouched.

11. The method of claim 10, wherein when the suit of the losing card only matches in color the suit card the player placed the bet on and the player still has bets on cards, the dealer halves the value of the player's bet on the suit card by moving the chips onto a line, so that one-half of the chips remain on the suit card; in case the same situation repeats itself, the bet is reduced by half again, and the chips are moved onto a corner of the card, so that one-quarter of the chips remain on the card.

12. The method of claim 1, wherein the dealer pays the player on the suit card, increasing his bet on it depending on the suit of a dealt card: for a winning card with the same suit as the bet, the bet is doubled; for a winning card that matches only in color, the bet is increased 1.5 times; if the suit does not match, the bet remains unchanged.

13. The method of claim 12, wherein the player's bet on the suit card needs to be doubled, and his chip is on a line or in a corner, the dealer moves the chip from the corner to the line or from the line onto the suit card.

14. The method of claim 1, wherein any pair of numerically identical cards is dealt in one hand, the dealer takes only chips that were bet on the suit-less card of dealt cards, and any chips that were bet on the suit cards remain untouched, regardless of the suit of the dealt cards.

15. The method of claim 14, wherein the dealer returns any chips remaining on the suit cards after player's final hand is played.

16. The method of claim 1, wherein the player may end the game after the final card upon which he has placed a bet is dealt.

17. The method of claim 1, wherein after all the cards upon which players have placed bets have been dealt, and all the bets have been accounted for, the dealer stops dealing cards from the shoe.

18. The method of entertainment according to claim 1, realized with the aid of electronic device provided with a monitor, comprising the following steps:

managing data processing and fulfillment of user's commands by a computer program that has been saved on a disk, feeding information into an electronic device by at least one means of input, providing a random number generator, providing an electronic deck of playing cards, forming an electronic image of the game field, and providing buttons for placing bets by the player.

* * * * *